United States Patent [19]

Hartnig

[11] 4,161,091

[45] Jul. 17, 1979

[54] APPARATUS FOR MAKING A CONNECTED SERIES OF STUFFED SEALED ENVELOPE ASSEMBLIES

[75] Inventor: Richard E. Hartnig, Green Bay, Wis.

[73] Assignee: Paper Converting Machine Company, Green Bay, Wis.

[21] Appl. No.: 884,691

[22] Filed: Mar. 8, 1978

[51] Int. Cl.[2] ..... B65B 11/48

[52] U.S. Cl. ..... 53/206; 53/266 A; 93/63 R

[58] Field of Search ..... 53/206, 266 A, 460; 93/63 R, 63 M

[56] References Cited

U.S. PATENT DOCUMENTS 3,808,768 5/1974 Dobbs ..... 53/206 X 4,003,183 1/1977 Helm ..... 53/460

*Primary Examiner*—Othell M. Simpson

*Assistant Examiner*—Z. R. Bilinsky

*Attorney, Agent, or Firm*—Tilton, Fallon, Lungmus & Chestnut

[57] ABSTRACT

Apparatus for making a connected series of stuffed sealed envelope assemblies (conventionally referred to as "mailers") wherein a knife roll serves to control the advance of a return envelope toward a web providing an insert ply after which the knife severs the insert ply web along transverse terminal edges and without intermediate die cut connecting portions to provide the insert ply as fully useable segments (no waste) along with the series of return envelopes for envelopment between continuous webs to provide a series of mailers.

5 Claims, 6 Drawing Figures

APPARATUS FOR MAKING A CONNECTED SERIES OF STUFFED SEALED ENVELOPE ASSEMBLIES

BACKGROUND AND SUMMARY OF INVENTION

This invention relates to apparatus for making a connected series of stuffed sealed envelope assemblies and, more particularly, to apparatus wherein each assembly has at least one insert ply and one return envelope therein.

The stuffed sealed envelope assemblies with which the invention is concerned are those seen generally in U.S. Pat. No. 3,104,799 and which are conventionally referred to as "mailers". A mailer historically includes superposed plies including one or more office or master record plies and other plies defining a front and back of a sealed envelope and at least one insert ply within each sealed envelope. The envelopes are connected in a series and are defined by lines of transverse perforation in the plies for separating the sealed envelopes, one from another. It is noted that according to the U.S. Pat. No. 3,104,799 patent and current practice of the art, die cutouts are used to create a gap between the "useable" portions of the insert plies, these useable portions being enveloped by the outer plies of the mailer. The instant invention makes exact length inserts from a continuous web, and by using a unique combination of conveying means and different speeds, positions the return envelope in proper relationship to the insert plies, then cuts the inserts to length, thereby eliminating intermediate waste material between series of inserts.

Such mailers often include return envelopes which historically have been made of plies pasted together as seen, for example, in U.S. Pat No. 3,905,545. Envelope users have been accustomed to envelopes made up of single sheets which have been folded and glued together but the art of making mailers has not been able to provide such a return envelope within the outgoing mailer assembly. This heretofore unattained object is achieved by the instant invention through the use of a novel knife roll which controls the return envelope just prior to its entry into the path of the insert ply web and which also is employed to transversely sever the insert ply web into segments.

Other advantages and objects of the invention may be seen in the details in the ensuing specification.

DETAILED DESCRIPTION

The invention is described in conjunction with the accompanying drawing, in which FIG. 1 is a side elevational view (somewhat schematic) of a machine for producing mailers;

Figure 1:
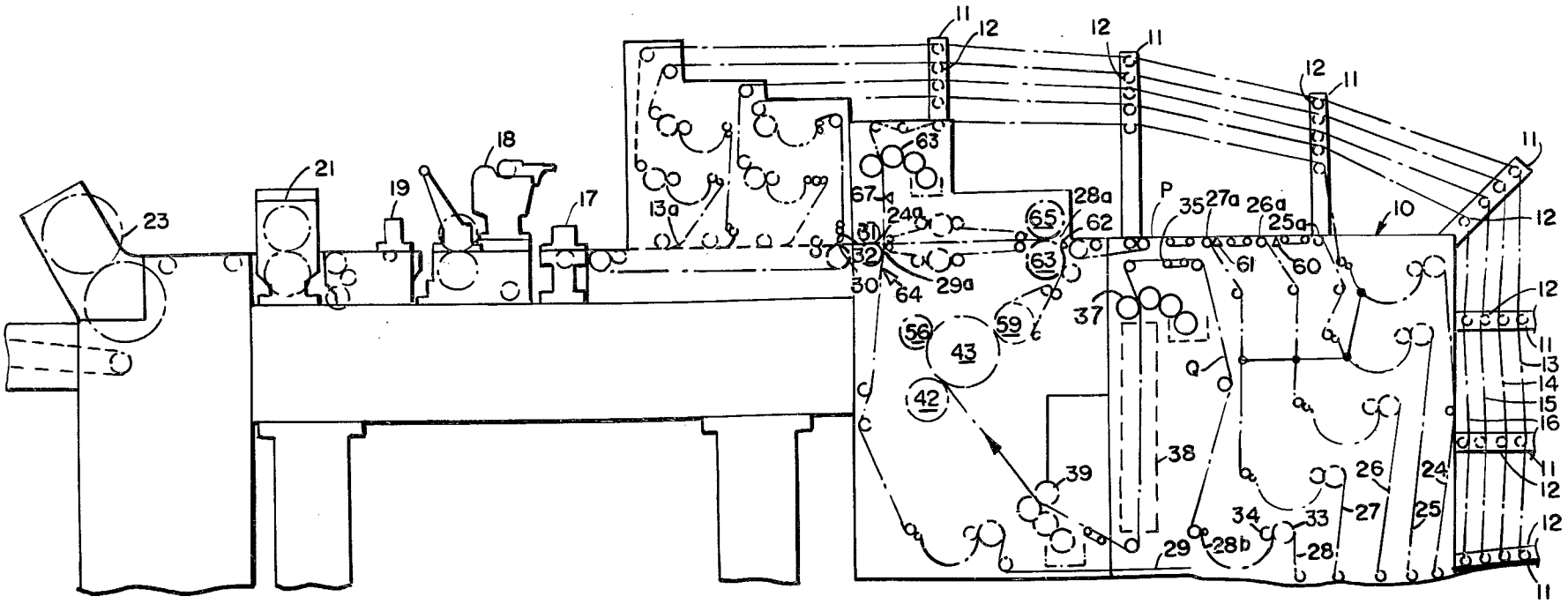

The drawing, particularly FIG. 1, is essentially a longitudinal elevation of a web processing machine and one specifically intended for the production of mailers. As such, it is a species of a business forms producing machine because the mailers for example, have line holes along the longitudinal edges which are also possessed by business forms. Such business forms producing machines are well known, being seen, for example, in U.S. Pat. No. 3,596,899. In general, the machines start with a number of parent rolls which usually are printed and which thereafter may be equipped with the line holes as by punching for further processing. The further processing may include original or further printing, manipulation to form envelopes as contemplated by the instant invention, and additional processing such as crimp-locking, crash numbering, lineal perforation, cross-perforation, folding, etc.

Referring now to FIG. 1, the numeral 10 designates generally the frame of the machine which, in accordance with the usual practice (particularly as seen in U.S. Pat. No. 3,596,899) consists of a pair of side frames suitable for supporting the various rolls and other devices used in processing the webs into business forms.

Not shown in FIG. 1 but providing the various webs seen in the right hand portion of FIG. 1 are a number of parent rolls. The rolls, as pointed out previously, may be either of pre-printed, pre-line hole punched web material or these operations may be performed between the unwind stands of the virgin parent rolls and the apparatus depicted in FIG. 1. In FIG. 1, the frame 10 provides a plurality of brackets 11 which support idler rolls 12. The rolls 12 on the brackets 11 support individually a number of continuous webs. For example, starting at the extreme right at the lower right hand portion of FIG. 1, the webs 13, 14, 15 and 16 will provide office or master record plies as can be appreciated from the schematic presentation in FIG. 2. These normally are only crimp-locked to the rest of the envelope assembly and are retained by the user of the product. Mailers are normally processed through computers which print through the various plies to provide information on invoicing, academic grades, etc. Thus, either carbon plies as such, or carbon spots on backings must be provided and this is true of the webs 13–16 which may be paper, carbon or spot carbon in any combination.

In the illustration given, the last web to be integrated with the other plies making up the mailer product is the web 13 which enters the path of advancement of the various webs at the point 13*a* after which all of the plies are crimp-locked together at the station 17. The numeral 18 designates a crash numbering unit, the numeral 19 to a lineal perforation station—to provide the lineal perforations designated 20 in FIG. 3, and the numeral 21 designates a cross-perforator which, in the illustration given, perforates the assemblies on 6" centers as at 22 in FIG. 2. Finally, the superposed plies encounter a folder 23 which may take the form illustrated in U.S. Pat. No. 3,596,899 and which was particularly concerned with the manipulation of webs toward the end of processing thereof.

Returning to the right hand portion of FIG. 1, the numeral 24 designates a web which ultimately becomes the envelope front of the mailer, entering the path P at the point designated 24*a*. The webs designated 25, 26 and 27 enter the path P at the points 25*a*, 26*a* and 27*a*, respectively, and constitute sources of intermediate ply segments for the ultimate mailer envelope.

The web 28 (again returning to the right hand lower portion of FIG. 1) is the web which develops the return envelope and which enters the path P at the point 28*a*. Lastly, the numeral 29 designates the web which becomes the envelope back and which enters the path P at the point designated 29*a*. For all practical purposes, the points 24*a* and 29*a* are the same, being the nip 30 between rolls 31 and 32.

The apparatus described thur far is essentially prior art but is set down for the purpose of describing the environment. The invention here is particularly concerned with the introduction of the return envelope into the mailer.

RETURN ENVELOPE MANUFACTURE

Figure 3:
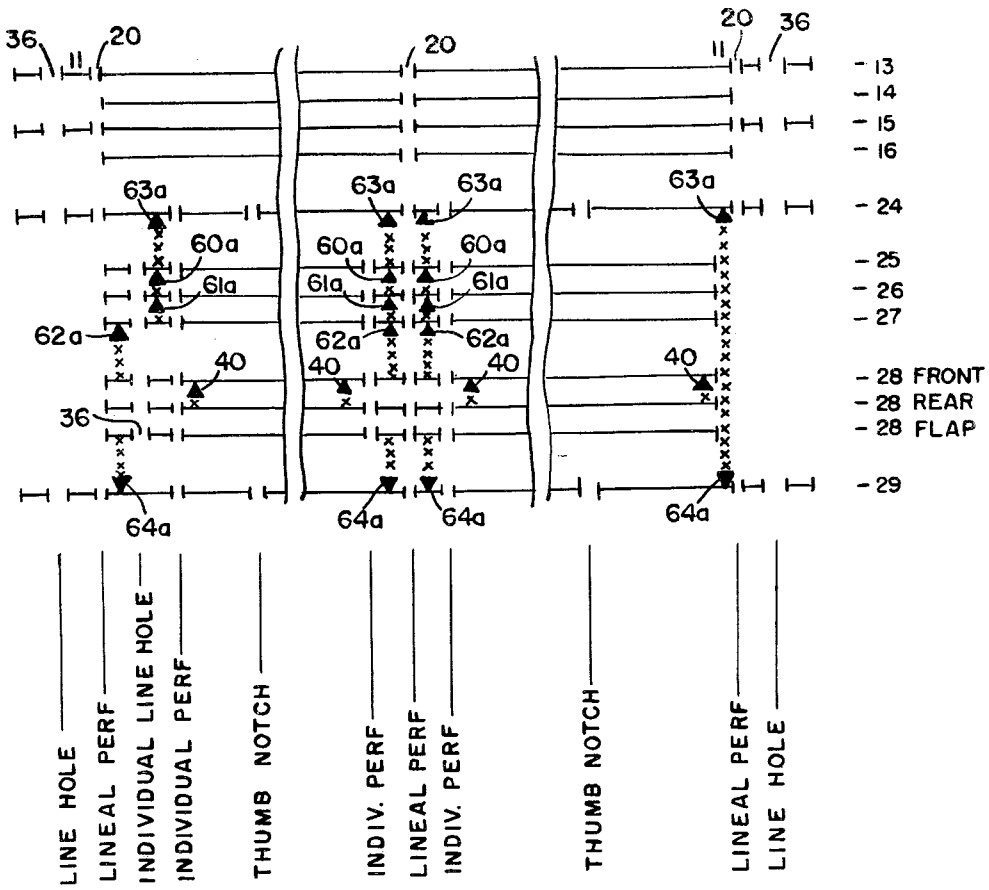
FIG. 3 is a transverse sectional view through the envelope assembly of FIG. 2.

The web 28 is seen to pass through draw rolls 33 and 34 suitably journalled on the sides of the machine frame 10 and which, in combination with a pin belt 35 develop a slack loop 28*b* in the web 28. The pin belt 35 normally consists of two transversely spaced apart "tractor" assemblies which engage the previously punched line holes in the web 28. In FIG. 3, for example, the line holes in the webs are designated 36. It will be appreciated that the control margin containing the holes 36 may be trimmed off before entering the folding rolls 42–43 to be described hereinafter. Also, the web 28 is advanced faster than the remaining webs inasmuch as the web has to provide in excess of double thicknesses within each return envelope assembly—as compared to the other webs (compare the completed return envelope R of FIG. 2 with the plies 13–16, 25–27 and 29).

For the purpose of creating the return envelope R (see FIGS. 2 and 3), the web 28 is advanced through a second path Q which is separate from the path P but which ultimately merges therewith at the point 28*a*.

While in the path Q, the web 28 passes through an adhesive applying unit 37. The unit 37 is employed to lay down a transversely extending band of adhesive at longitudinally spaced apart points on the web 28 and which ultimately become the flap adhesives which are activated by remoistening by the return envelope user—in conventional fashion. The remoistenable glue which is applied by the adhesive unit 37 is dried within the drier 38 after which longitudinally extending, interrupted lines of adhesive are applied to the web 28 by means of the adhesive unit 39. The lines of adhesive laid down by the unit 39 are seen at 40 in FIG. 3 (also FIG. 4) and normally are applied to only a portion of the web 28, i.e., a length corresponding only to the length of the back of the return envelope. This can be applied either to the "front" of the back or the "back" of the front—the latter being illustrated in FIGS. 3 and 6. Thereafter, when the web 28 is folded on itself to commence the creation of the return envelope, the adhesive-equipped back will adhere to an equal panel of the web to form the usual pocket of the envelope.

Figure 4:
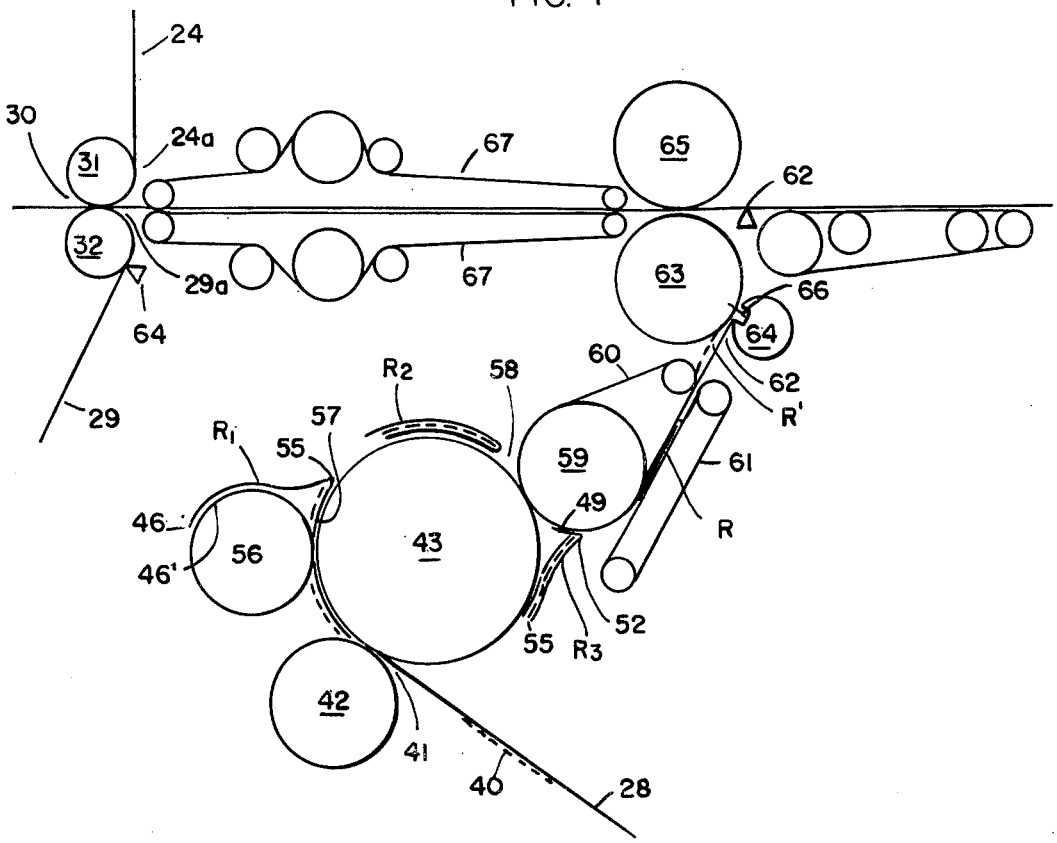
FIG. 4 is an enlarged fragmentary portion of FIG. 1 featuring the portion of the apparatus used for marrying the return envelope with the rest of the envelope assembly.
Figure 5:
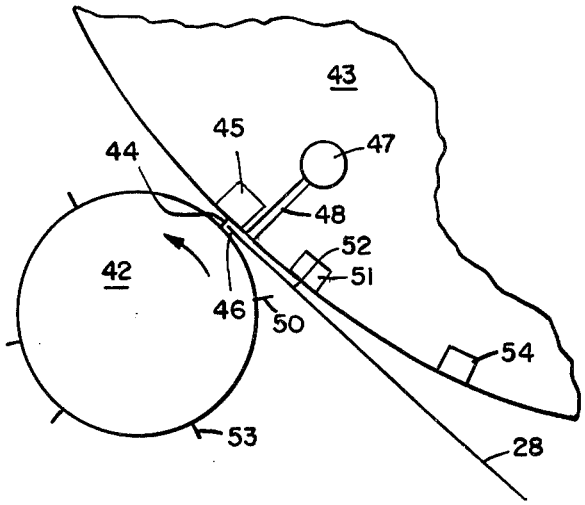
FIG. 5 is an exploded fragmentary view of the return envelop cutoff and perforating roll set.

FIG. 4 shows the return envelope R in various stages of creation. First, the web 28 (now equipped with the lines of adhesive 40 from the unit 39) is advanced toward the nip 41 between rolls 42 and 43. Roll 42 is a cutoff and perforating roll while roll 43 is a vacuum carrier roll. This initial operation is depicted in larger scale in FIG. 5. As seen there, cutoff and perforating roll 42 is equipped either a cutoff knife 44 which coacts with hardened anvil piece 45 to create leading edge 46 as seen in FIG. 5. When continuous web 28 is severed at 46, vacuum is effective (through manifold 47 and vacuum port 48) in holding web 28 against the surface of roll 43.

As leading edge 46 proceeds beyond cutoff a distance equal to the length of the flap (see the part designated 49 in the center of FIG. 4), perforating blade 50 will coact with anvil 51 and perforate a transverse line at the flap fold line (see 52 of FIG. 4), and upon further rotation of roll 42, perforating blade 53 will coact with anvil 54 to perforate a transverse panel fold line (see 55 of FIG. 4). However, in some instances fold lines may be developed without blades and anvils as by printing, etc.

Referring now to FIG. 4, leading edge 46 is advanced to the nip between rolls 43–56 at which time similar vacuum means cause the leading edge 46 and undersurface 46' just rearward of the edge 46 to adhere to roll 44 while the trailing portion 57 is held in intimate contact with roll 43 to provide the configuration designated $R_1$.

As roll 43 rotates, vacuum is released from roll 44 and the front panel portion (which includes flap 49) is in overlying relationship to portion 57 as at $R_2$. Thereafter, as the folded panels pass into the nip 58 between the rolls 43 and 59, adhesive line 40 adheres the front panel to the back panel of the envelope, and the flap 49 is held to roll 59 to develop the configuration $R_3$. Vacuum is then released on roll 43 relative to the envelope in the position designated $R_3$. As roll 59 rotates, the vacuum means of roll 59 is released as the almost folded envelope is stripped from roll 59 by belts 60 which then coact with belts 61 to securely hold and transfer the folded envelope toward a nip 62.

RETURN ENVELOPE MANIPULATION

The nip 62 is defined between a cutoff knife roll 63 and a register roll 64. The surface speed of these rolls is the same as that of webs traveling in the path P and, in fact, the knife carrying cutoff roll 63 is positioned in side-by-side relation with anvil roll 65 much the same as it is with the roll 64. The knife cutoff roll 63 in combination with the roll 65 operates to transversely sever the webs 25–27 into discrete segments constituting the insert plies so identified in FIG. 2.

The carrier belts 60 and 61 are driven at the surface speed of the roll 59, this speed being slightly more than twice the lineal speed of the webs 25–27. The high speed of web 28 is required because of the return envelope panel folding relationship and also to cause the folded return envelope R to abut against the knife 66 as indicated in dotted line and designated R' in the central right hand side of FIG. 4. This controls the position of the leading edge of the envelope R so that it will be positioned in transverse alignment with the leading edges of the insert ply segments developed from the webs 25–27—again as can be appreciated from a consideration of FIG. 2.

Figure 2:
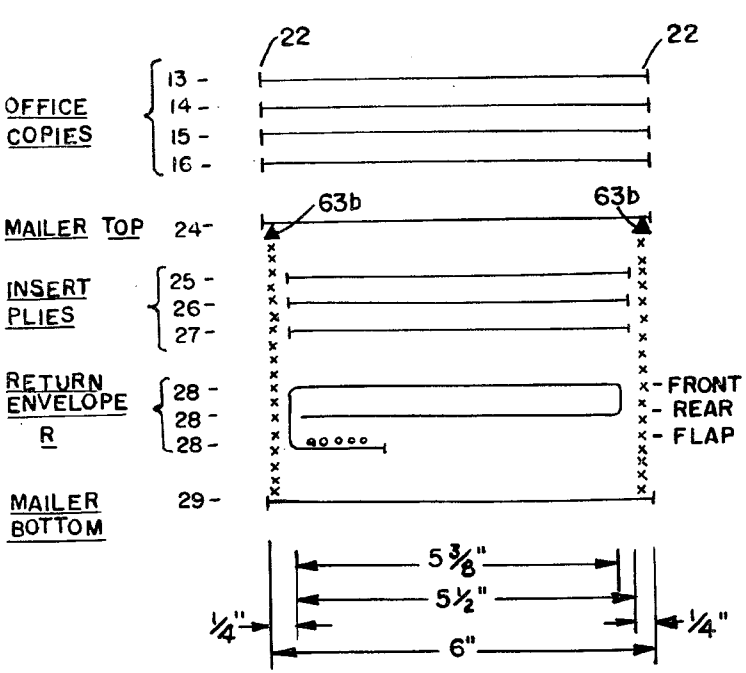
FIG. 2 is an exploded side elevational view (somewhat schematic) of a single envelope assembly produced by the inventive apparatus.
Figure 6:
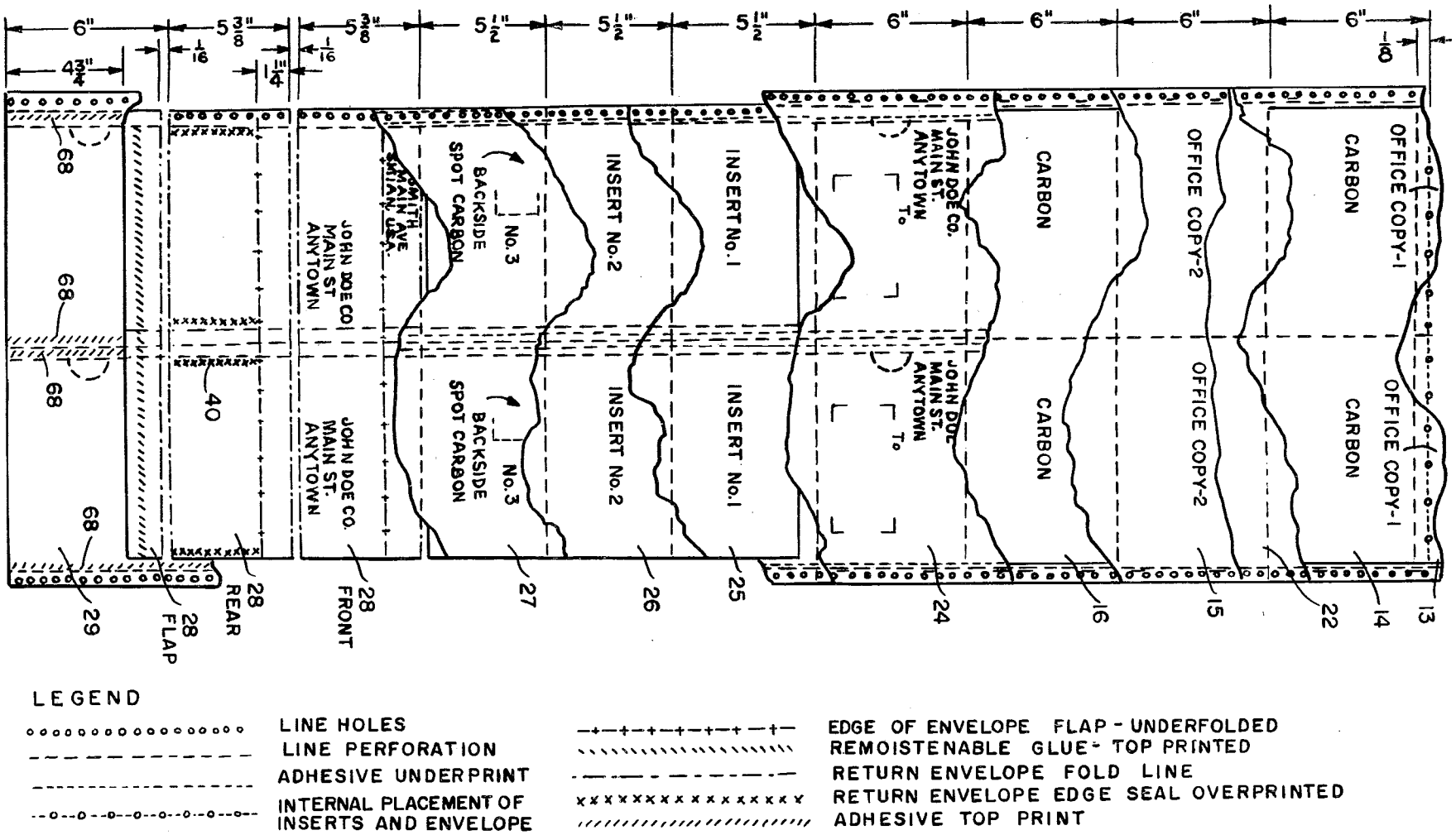
FIG. 6 is a plan view of a mailer produced according to the invention with portions broken away.

When the segments of webs 25–27 and the return envelope R emerge from the nip between the rolls 63 and 65, they are engaged by a pair of speed-up belts 67. The speed-up belts 67 are employed to develop a greater spacing between sequential sets of insert material so as to facilitate the enveloping thereof between the webs 24 and 29 in the nip 30. In FIGS. 2 and 6, the webs 13–16, 24 and 29 are perforated on 6" centers, i.e., transverse lines separated 6" longitudinally. As illustrated in FIG. 2, the insert plies 25–27 are 5½" long and the speed up belts are adjusted to space the insert plies ½" apart, i.e., on 6" centers. The insert/return envelope unitary stacks are placed centrally within each consecutive 6" long mailing envelope made from top web 24 and bottom web 29. It is within the scope of this invention to produce different sizes with intermediate gap spacing in any combination.

The insert plies 25–27 and the return envelope R at the time of entering the nip 30, constitute a unitary stack by virtue of inter-ply adhesive shown in FIG. 3. For example, adhesive is applied at the station 60—see the central right hand portion of FIG. 1—to the underside of the web 25 which serves to unite the web 25 to the web 26 as at 60*a* in FIG. 3. A corresponding set of glue applicators as at 61 is provided to unite the web 26 to the web 27 along the glue lines 61*a* as illustrated in FIG. 3. Lastly, a set of adhesive applicators 62 are employed to lay down bands of adhesive 62*a* to the underside of web 27 for the purpose of uniting the glued stack of insert webs 25–27 to the topmost ply (front) of the unitary envelope R.

Thus, the arrangement of elements depicted in FIG. 4 results in the presentation in spaced relation along the path P of a number of unitary sets all aligned and ready for enveloping between the webs 24 and 29 at the nip 30. Spaced-registered longitudinal glue lines 63*a* are applied to the underside of the web 24 at the glue station 63. This station also applies transverse glue lines 63*b*—see FIG. 2. Other longitudinal lines of glue as at 64*a* (see FIG. 3) are applied by a set of glue applicators 64 (see FIG. 4) to the topside of the web 29 just before it enters the nip 30.

Thereafter, the mailer assembly made up of front web 24, insert plies 25, 26 and 27, return envelope R (derived from web 28) and back 29 continue movement in the path P and receive thereon the office copy webs 13–16. The crimp lock, crash numbering, perforation, etc. described previously are then performed on the superposed webs.

I claim:

1. Apparatus for making a connected series of stuffed sealed envelope assemblies, each having at least one insert ply and one return envelope therein comprising a frame, means on said frame for advancing an elongated insert ply web along a first path, means for advancing a series of return envelopes along a second path toward said first path and at a lineal speed faster than the speed of advance of said insert ply web, knife roll means on said frame in said second path for controlling the advance of each return envelope and for directing each return envelope into said first path while transversely severing said insert ply web into segments, and means on said frame for enveloping said return envelopes and insert ply segments between continuous webs.

2. The apparatus of claim 1 in which said knife roll means includes a knife roll having a knife blade extending axially thereof and projecting beyond the periphery thereof, a register roll on said frame in side-by-side relation to said knife roll and equipped with an axially extending slot for receiving said projecting knife blade and thereby providing a barrier controlling the advance of said return envelope.

3. The apparatus of claim 2 in which said frame is equipped with an anvil roll also arranged in side-by-side relation to said knife roll and cooperating with the knife thereof for transversely severing said insert ply web to exact length along a common line intermediate consecutive insert ply sets.

4. The apparatus of claim 1 in which said frame is equipped with speed-up belt means in said path downstream of said knife roll means for spacing successive segments of said insert ply web prior to envelopment thereof.

5. The apparatus of claim 1 in which said frame includes means for advancing an elongated return envelope web along said second path, means on said frame in said second path for applying adhesive to said return envelope ply web along longitudinally spaced apart, transversely extending bands, means on said frame in said second path for applying adhesive to said return envelope ply web along interrupted, longitudinally extending lines, means on said frame in said second path for transversely severing said return envelope ply web adjacent each of said transversely extending bands to define discrete return envelope plies, each having a specified length between the ends thereof and a transversely extending band of adhesive adjacent one end thereof, said interrupted lines of adhesive terminating adjacent the other end of each discrete return envelope ply, means on said frame in said second path for first folding each discrete return envelope ply on itself along a transverse line positioned between the ends thereof and closer to said other end than said one end to provide front and back panels with said back panel being shorter than said front panel, said folding step bringing said back panel into adhesive union with a portion of said front panel, the remainder of said front panel other than said portion constituting an envelope flap, and means on said frame in said second path for second folding each first folded return envelope ply on itself along a transverse line and develop said envelope flap.

* * * * *